US011311160B2

(12) United States Patent
Bosses

(10) Patent No.: US 11,311,160 B2
(45) Date of Patent: Apr. 26, 2022

(54) VACUUM CLEANER ASSEMBLY HAVING REMOVABLE HANDHELD VACUUM CLEANER

(71) Applicant: Zenith Technologies, LLC, Fort Lauderdale, FL (US)

(72) Inventor: Mark D Bosses, Boca Raton, FL (US)

(73) Assignee: ZENITH TECHNOLOGIES, LLC, Fort Lauderdale, FL (US)

( * ) Notice: Subject to any disclaimer, the term of this patent is extended or adjusted under 35 U.S.C. 154(b) by 234 days.

(21) Appl. No.: 16/715,953

(22) Filed: Dec. 16, 2019

(65) Prior Publication Data

US 2021/0177221 A1 Jun. 17, 2021

(51) Int. Cl.

| | |
|---|---|
| ***A47L 9/00*** | (2006.01) |
| ***A47L 9/16*** | (2006.01) |
| ***A47L 9/28*** | (2006.01) |
| ***A47L 5/24*** | (2006.01) |

(52) U.S. Cl.

CPC ..... *A47L 9/0018* (2013.01); *A47L 5/24* (2013.01); *A47L 9/1683* (2013.01); *A47L 9/2873* (2013.01); *A47L 9/2884* (2013.01)

(58) Field of Classification Search

CPC ... A47L 5/225; A47L 5/24; A47L 5/28; A47L 9/0018; A47L 9/1683; A47L 9/2873; A47L 9/2884

See application file for complete search history.

(56) References Cited

U.S. PATENT DOCUMENTS

| | | | | |
|---|---|---|---|---|
| 4,683,607 | A * | 8/1987 | Lackner | A47L 9/0009 15/323 |
| 5,524,321 | A | 6/1996 | Weaver et al. | |
| 2006/0191099 | A1* | 8/2006 | Fry | A47L 5/225 15/353 |
| 2018/0353029 | A1* | 12/2018 | Tolchard | A47L 5/24 |
| 2019/0380548 | A1* | 12/2019 | Moeller | A47L 5/36 |
| 2020/0000300 | A1* | 1/2020 | Moeller | A47L 9/009 |

FOREIGN PATENT DOCUMENTS

| | | | | |
|---|---|---|---|---|
| CN | 110353559 | A * | 10/2019 | |
| WO | 2005084511 | A1 | 9/2005 | |
| WO | WO-2007088192 | A1 * | 8/2007 | A47L 9/2873 |
| WO | WO-2020038423 | A1 * | 2/2020 | A47L 5/28 |

* cited by examiner

*Primary Examiner* — Marc Carlson

(74) *Attorney, Agent, or Firm* — Global IP Counselors, LLP

(57) ABSTRACT

A vacuum cleaner assembly basically includes a vacuum cleaner and a handheld vacuum cleaner. The vacuum cleaner includes a first motor configured to create flow through a first suction path. The first motor is configured to be powered by a first power source. A first dust bin is disposed in a first housing and is in fluid communication with the first suction path. The handheld vacuum cleaner is removably connected to the vacuum cleaner. The handheld vacuum includes a second motor configured to create flow through a second suction path. The second motor being configured to be powered by a second power source. A second dust bin is connected to a second housing and is in fluid communication with the second suction path.

20 Claims, 11 Drawing Sheets

VACUUM CLEANER ASSEMBLY HAVING REMOVABLE HANDHELD VACUUM CLEANER

BACKGROUND

Field of the Invention

This invention generally relates to a vacuum cleaner assembly. More specifically, the present invention relates to a vacuum cleaner assembly having a handheld vacuum cleaner removably connected to a vacuum cleaner.

Background Information

Vacuum cleaners, such as upright vacuum cleaners, typically have a flexible hose to clean areas not easily cleaned with a suction head of the vacuum cleaner. A plurality of accessories can be removably connectable to a free end of the flexible hose. The accessory is selected depending on the area to be cleaned. The other end of the flexible hose is fixedly connected to the vacuum cleaner, such as to the suction head. Manipulating the flexible hose is burdensome and time consuming, as well as unwieldy. Switching between cleaning with the suction head and the flexible hose is burdensome.

SUMMARY

Generally, the present disclosure is directed to various features of a vacuum cleaner assembly. In one feature, a handheld vacuum cleaner is removably connected to a vacuum cleaner to provide a quick and easy alternative to a suction head of the vacuum cleaner.

In view of the state of the know technology and in accordance with a first aspect of the present disclosure, a vacuum cleaner assembly basically includes a vacuum cleaner and a handheld vacuum cleaner. The vacuum cleaner includes a first motor configured to create flow through a first suction path. The first motor is configured to be powered by a first power source. A first dust bin is disposed in a first housing and is in fluid communication with the first suction path. The handheld vacuum cleaner is removably connected to the vacuum cleaner. The handheld vacuum includes a second motor configured to create flow through a second suction path. The second motor being configured to be powered by a second power source. A second dust bin is connected to a second housing and is in fluid communication with the second suction path.

In accordance with a second aspect of the present invention, the vacuum cleaner assembly according to the first aspect is configured such that the second power source is a rechargeable battery disposed in the second housing.

In accordance with a third aspect of the present invention, the vacuum cleaner assembly according to the second aspect is configured such that first power source is an electrical outlet.

In accordance with a fourth aspect of the present invention, the vacuum cleaner assembly according to the first aspect is configured such that the first suction path is separate from the second suction path.

In accordance with a fifth aspect of the present invention, the vacuum cleaner assembly according to the first aspect includes a support member removably connected to the vacuum cleaner, and the support member removably receiving the handheld vacuum.

In accordance with a sixth aspect of the present invention, the vacuum cleaner assembly according to the second aspect is configured such that the support member includes a charging circuit to charge the rechargeable battery.

In accordance with a seventh aspect of the present invention, the vacuum cleaner assembly according to the sixth aspect is configured such that the support member includes a power cord configured to be connected to an electrical socket to charge the rechargeable battery when the support member is removed from the vacuum cleaner.

In accordance with an eighth aspect of the present invention, the vacuum cleaner assembly according to the fifth aspect is configured such that an accessory is configured to be removably connected to the handheld vacuum and removably received by the support member. The accessory is powered by a third power source.

In accordance with a ninth aspect of the present invention, the vacuum cleaner assembly according to the sixth aspect is configured such that the charging circuit charges the rechargeable battery when the support member is connected to the vacuum cleaner.

In accordance with a tenth aspect of the present invention, the vacuum cleaner assembly according to the fifth aspect is configured such that the support member is configured to receive an accessory configured to be connected to the handheld vacuum cleaner.

In accordance with an eleventh aspect of the present invention, the vacuum cleaner assembly according to the first aspect is configured such that the handheld vacuum cleaner includes a suction inlet in fluid communication with the second suction path, and the suction inlet being covered by the support member when the handheld vacuum cleaner is received by the support member.

In accordance with a twelfth aspect of the present invention, the vacuum cleaner assembly according to the sixth aspect is configured so that the support member includes a charge level indicator to indicate a charge level of the rechargeable battery.

In accordance with a thirteenth aspect of the present invention, the vacuum cleaner assembly according to the first aspect is configured such that the first power source is a power cord configured to be connected to an electrical socket.

In accordance with a fourteenth aspect of the invention, the vacuum cleaner assembly according to the first aspect is configured such that the vacuum cleaner and the handheld vacuum cleaner are operable at the same time when the handheld vacuum cleaner is not connected to the vacuum cleaner.

In accordance with a fifteenth aspect of the invention, the vacuum cleaner assembly according to the first aspect is configured such that the first dust bin is accessible when the handheld vacuum cleaner is connected to the vacuum cleaner.

In accordance with a sixteenth aspect of the invention, the vacuum cleaner assembly according to the first aspect is configured such that the second dust bin is inaccessible when the handheld vacuum cleaner is connected to the vacuum cleaner.

In view of the state of the known technology and in accordance with a seventeenth aspect of the present disclosure, a vacuum cleaner assembly basically includes a vacuum cleaner and a handheld vacuum cleaner. The vacuum cleaner includes a first motor configured to create flow through a first suction path. The first motor is configured to be powered by a first power source. A first dust bin is disposed in a first housing and is in fluid communication with the first suction path. The handheld vacuum cleaner is removably connected to the vacuum cleaner. The handheld vacuum cleaner includes a second motor configured to create flow through a second suction path. The second motor is configured to be powered by a second power source. A second dust bin is connected to a second housing and is in fluid communication with the second suction path. The first suction path is separate from the second suction path. The vacuum cleaner and the handheld vacuum cleaner are operable at the same time when the handheld vacuum cleaner is not connected to the vacuum cleaner.

In accordance with an eighteenth aspect of the present invention, the vacuum cleaner assembly according to the seventeenth aspect is configured such that the second power source is a rechargeable battery disposed in the second housing, and the support member includes a charging circuit configured to charge the rechargeable battery.

In accordance with a nineteenth aspect of the present invention, the vacuum cleaner assembly according to the eighteenth aspect is configured such that the charging circuit charges the rechargeable battery when the support member is connected to the vacuum cleaner.

In accordance with a twentieth aspect of the present invention, the vacuum cleaner assembly according to the eighteenth aspect is configured such that an accessory is configured to be removably connected to the handheld vacuum and removably received by the support member. The accessory is powered by a third power source.

Also, other objects, features, aspects and advantages of the disclosed vacuum cleaner assembly will become apparent to those skilled in the art from the following detailed description, which, taken in conjunction with the annexed drawings, discloses several embodiments of a vacuum cleaner assembly.

BRIEF DESCRIPTION OF THE DRAWINGS

Referring now to the attached drawings which form a part of this original disclosure.

Throughout the drawing figures, like reference numerals will be understood to refer to like parts, components and structures.

DETAILED DESCRIPTION OF EXEMPLARY EMBODIMENTS

Figure 1:
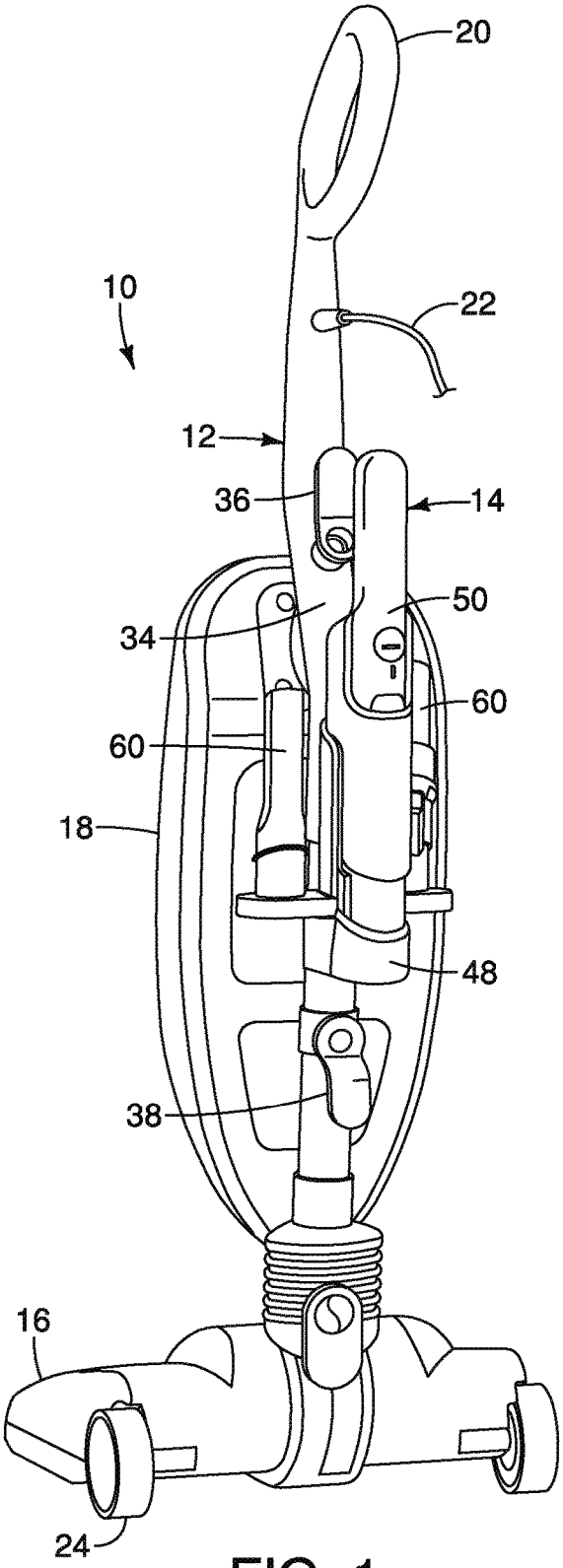
FIG. 1 is a perspective view of a vacuum cleaner assembly in accordance with an exemplary embodiment of the present invention.

Selected exemplary embodiments will now be explained with reference to the drawings. It will be apparent to those skilled in the art from this disclosure that the following descriptions of the exemplary embodiments are provided for illustration only and not for the purpose of limiting the invention as defined by the appended claims and their equivalents.

As shown in FIGS. 1-5, a vacuum cleaner assembly 10 in accordance with an exemplary embodiment of the present invention includes a vacuum cleaner 12 and a handheld vacuum cleaner 14. The handheld vacuum cleaner 14 is removably connected to the vacuum cleaner 12.

The vacuum cleaner 12 includes a suction head or base 16, a housing 18 for receiving debris, a handle 20, and a power cord 22 for connecting the vacuum cleaner 12 to a source of electrical power. The housing 18 includes a dust bin 46, such as a vacuum bag or any other suitable apparatus, for receiving dirt, dust or other debris collected during operation of the vacuum cleaner 12. The vacuum cleaner 12 can be any suitable type of vacuum cleaner, such as, but not limited to, direct air and bypass air upright vacuum cleaners, canister vacuum cleaners, stick vacuum cleaners and multi-surface vacuum cleaners. The various components and interactions of the vacuum cleaner 12 would be understood by one of ordinary skill in the art.

The base 16 includes a plurality of wheels 24 rotatably connected to the base 16 to facilitate pushing and pulling the vacuum cleaner 12 during operation. A surface agitator 26, such as a brush roll, is movably disposed in the base 12. A suction inlet 28 is disposed in the base 16 in association with the surface agitator 26. A first suction path 30 extends from the suction inlet 28 in the base 16, through a passage 32 in an intake tube 34 to the dust bin 46 disposed in the housing 18, as shown in FIG. 5.

The handle 20 is connected to an upper end of the intake tube 34. The handle 20 can be removably connected to the upper end of the intake tube 34 of integrally formed there-with as a one-piece assembly. The intake tube 34 includes an upper cord hook 36 and a lower cord hook 38 around which the power cord 22 can be wrapped when storing the vacuum cleaner assembly 10.

Figure 5:
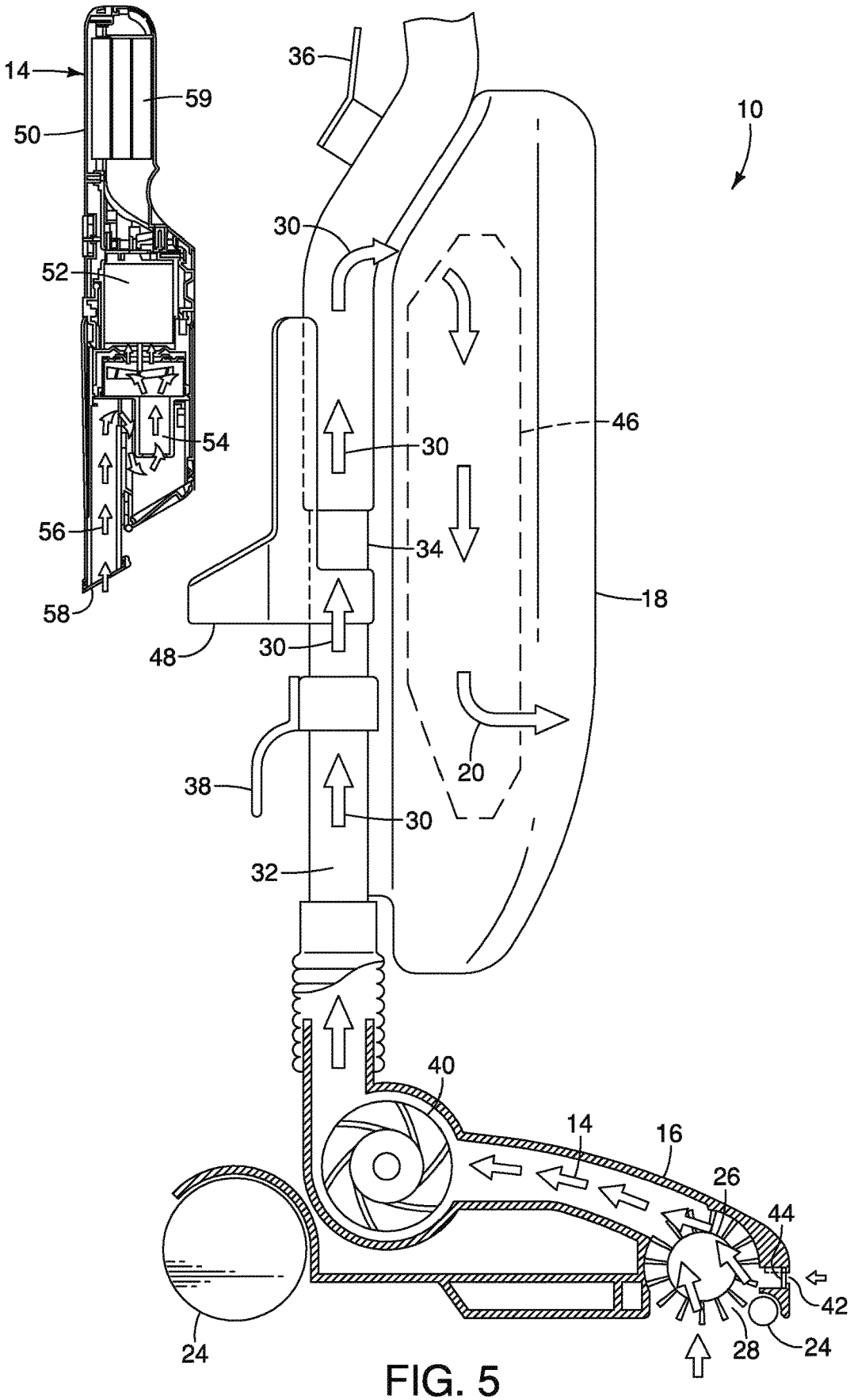
FIG. 5 is an elevational view in cross section of the vacuum cleaner and the handheld vacuum cleaner of FIG. 3.
Figure 6:
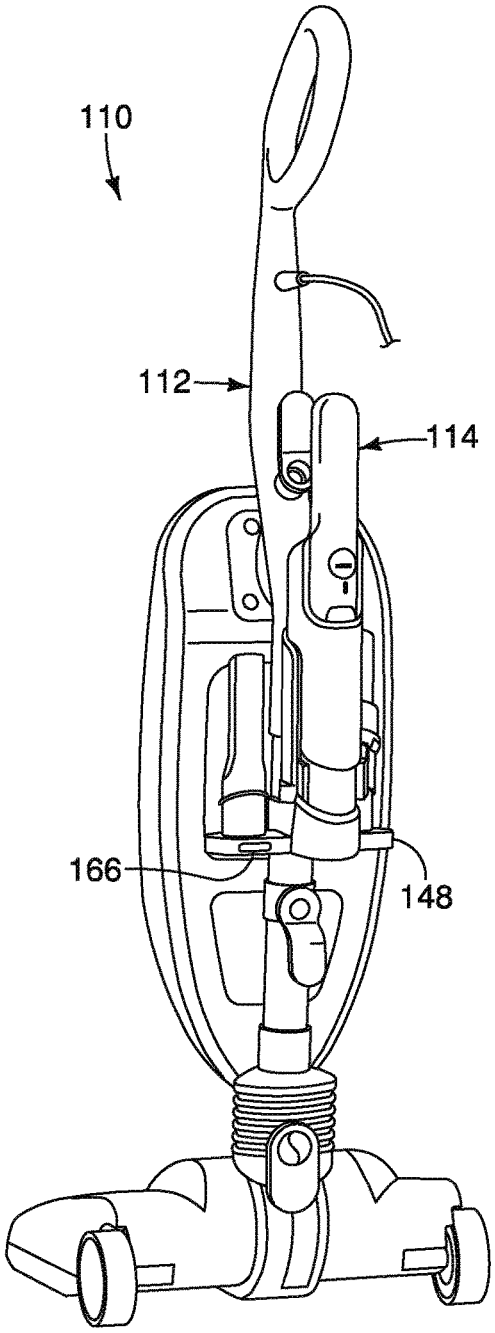
FIG. 6 is a perspective view of a vacuum cleaner assembly in accordance with another exemplary embodiment of the present invention.
Figure 10:
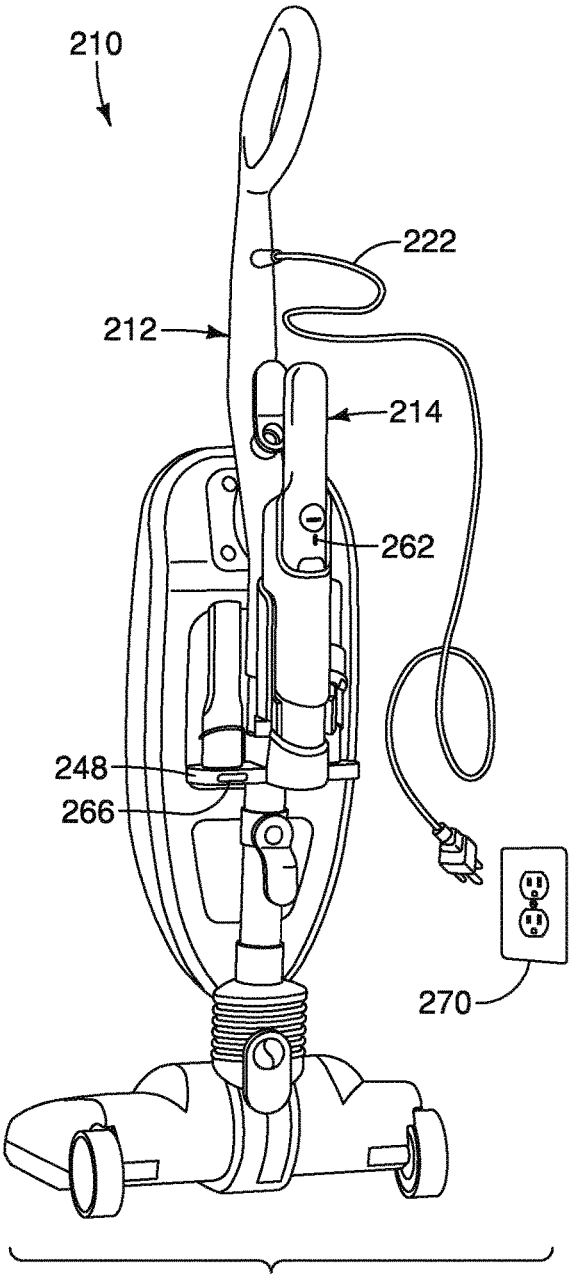
FIG. 10 is a perspective view of a vacuum cleaner assembly in accordance with another exemplary embodiment of the present invention.

A suction motor 40 is disposed in the base 16 of the vacuum cleaner 12, as shown in FIG. 5. Alternatively, the suction motor 40 can be disposed elsewhere, for example in the body of the vacuum cleaner 12 or in any other suitable location. The suction motor 40 generates a suction force, as shown in FIG. 5, to create flow through the first suction path 30. The flow of the first suction path 30 is from the suction inlet 28 in the base 16, through the passage 32 in the intake tube 34, and into the housing 18. The motor 40 also drives the surface agitator 26. Alternatively, a separate motor can be used to drive the surface agitator 26. The suction motor 40 is configured to be powered by a first power source, such as an electrical outlet 270 (FIG. 10).

A second inlet 42 can be disposed in the base 16, as shown in FIG. 5. The second inlet 42 is in fluid communication with the first suction path 30. A cover 44 is movably connected to the base 16 to move between a closed position covering the second inlet 42 and an open position allowing fluid to flow through the second inlet 42. When the cover 44 is in the closed position (shown in solid lines in FIG. 5), fluid flow through the second inlet 42 is substantially prevented. When the cover 44 is in the open position (shown in dashed lines in FIG. 5), air flows through the second inlet 42 to the first suction path 30, thereby generating fluid flow through the second inlet 42 and relieving suction through the first inlet 28. When powered during operation of the vacuum cleaner 12, air is drawn into the first suction path 30 through the first inlet 28 in the base 16. When the cover 44 is in the open position, air is drawn into the suction path 30 through the first inlet 28 and through the second inlet 42. By relieving the suction through the first inlet 28, the vacuum cleaner 12 becomes easier to push and pull such that the mobility of the vacuum cleaner 12 will be easier for the user. Additionally, slowing down or stopping the surface agitator 26 is relieved or eliminated.

The dust bin 46, such as a vacuum bag, is disposed in the housing 16, as shown in FIG. 5. The first suction path 30 flows into and through the dust bin 46, thereby trapping dust, dirt and other debris carried through the first suction path 30 inside the dust bin 46. The housing 18 can be opened to discard a full dust bin 46, and to attach a new dust bin 46. Alternatively, the dust bin 46 can be integrally formed with the housing 16, and emptied and cleaned in any suitable manner.

Figure 3:
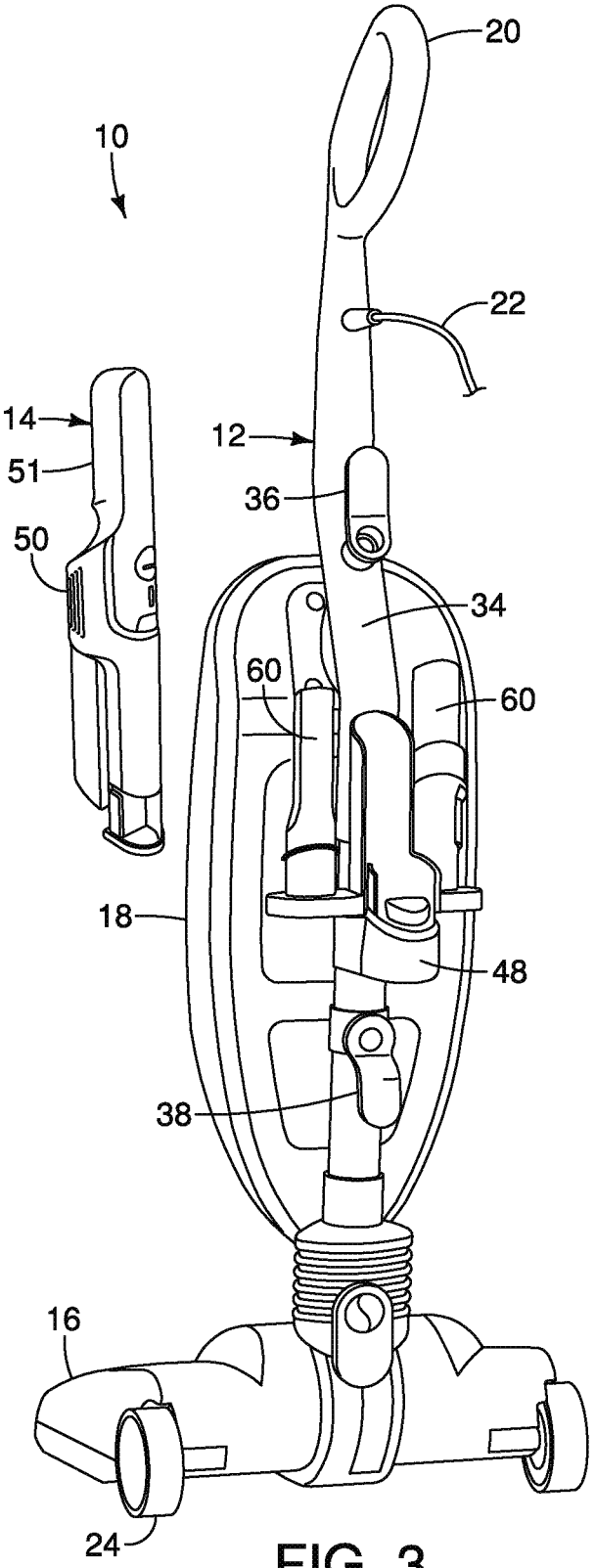
FIG. 3 is an exploded assembly view of the vacuum cleaner assembly of FIG. 2.
Figure 4:
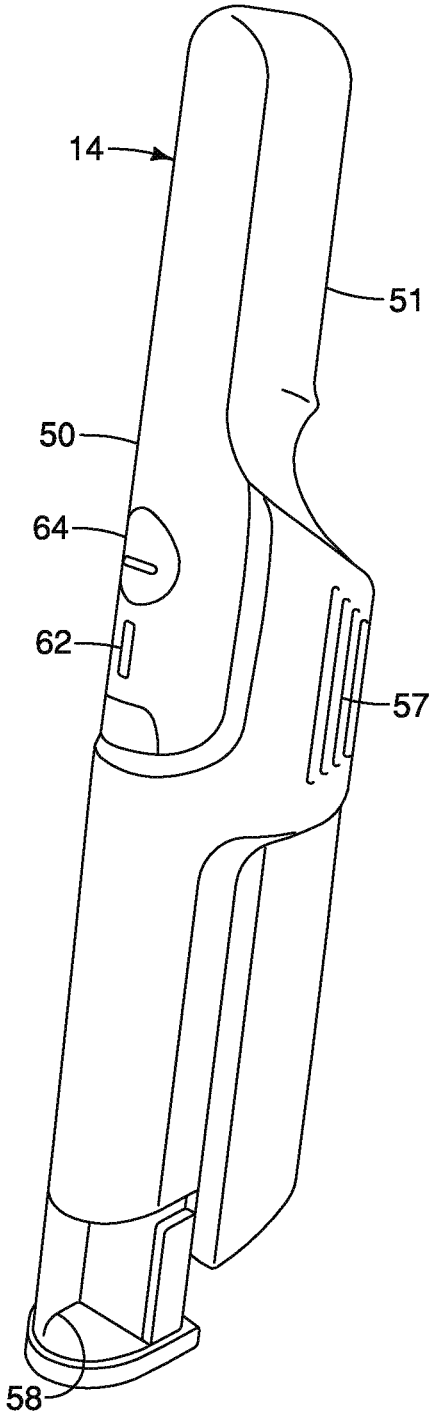
FIG. 4 is a perspective view of a handheld vacuum cleaner detached from the vacuum cleaner of FIG. 1.

The handheld vacuum cleaner 14 is removably connected to the vacuum cleaner 12, as shown in FIG. 3. A support member 48 is removably connected to the intake tube 34, or any other suitable location, of the vacuum cleaner 14 and removably receives the handheld vacuum cleaner 14. The support member 48 can be removably connected to the vacuum cleaner 14 in any suitable manner that facilities connecting and disconnecting the support member to and from the vacuum cleaner 14.

The handheld, vacuum cleaner 14 includes a housing 50, as shown in FIGS. 1-5. A suction motor 52 and a dust bin 54 are disposed in the housing 50, as shown in FIG. 5. The housing 50 can be opened to access the dust bin 54 to empty the contents stored therein and to clean the dust bin 54. The housing 50 includes a gripping portion 51 to facilitate handling the handheld vacuum cleaner 14.

The suction motor 52 of the handheld vacuum cleaner 14 creates flow through a second suction path 56, as shown in FIG. 5. The second suction path 56 extends from a suction inlet 58 of the handheld vacuum cleaner to the dust bin 54. The second suction path 56 flows into and through the dust bin 54, thereby trapping dust, dirt, and other debris carried through the second suction path 56 inside the dust bin 54. The housing 50 can be opened to empty the dust bin 54 when full. The second suction path 56 exits the housing 50 through vents 57 (FIG. 4) disposed therein. As shown in FIG. 5, the first suction path 30 is separate from the second suction path 56, in other words, there is no fluid communication between the first and second suction paths 30 and 56. No portion of the first suction path 30 flows through the handheld vacuum cleaner 14. No portion of the second suction path 56 flows through the vacuum cleaner 12.

The suction motor 52 of the handheld vacuum cleaner 14 is configured to be powered by a second power source, such as a rechargeable battery 59. As shown in FIG. 5, three rechargeable batteries 59 are disposed in the housing 50, although any suitable number of rechargeable batteries can be used.

Figure 2:
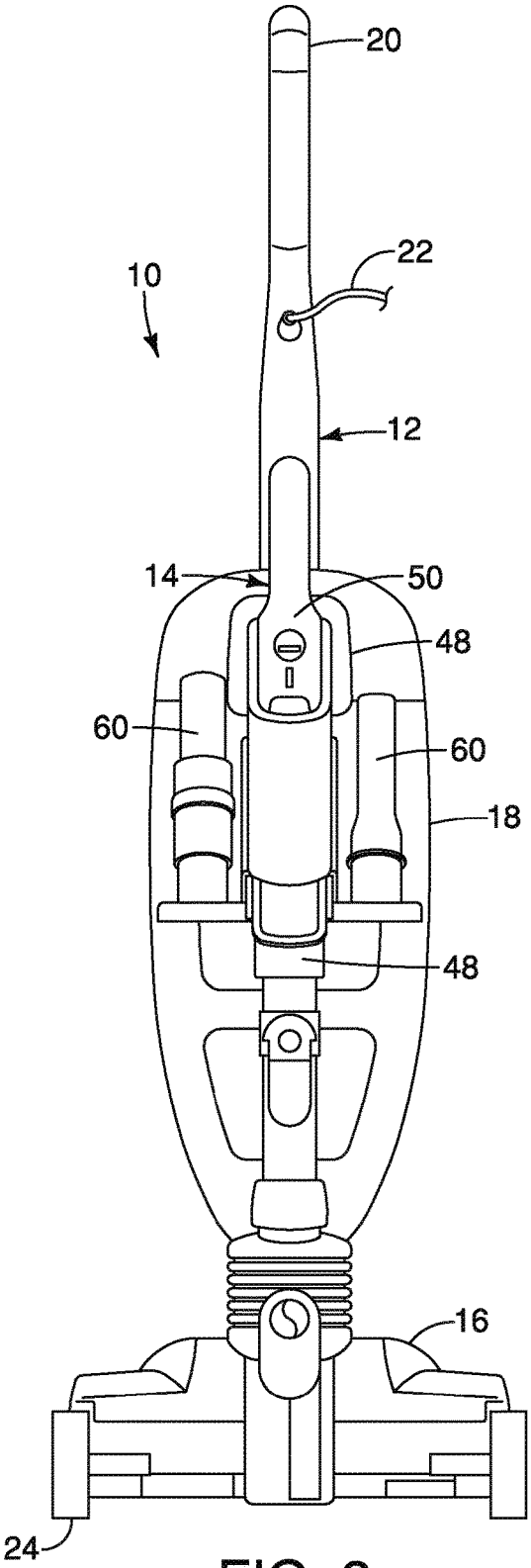
FIG. 2 is an elevational view of the vacuum cleaner assembly of FIG. 1.

An accessory 60, such as a brush or a nozzle, can be removably received by the support member 48, as shown in FIGS. 1-3. The accessory 60 is configured to be removably connected to the suction inlet 58 of the handheld vacuum cleaner 14 to provide alternative cleaning options.

Figure 7:
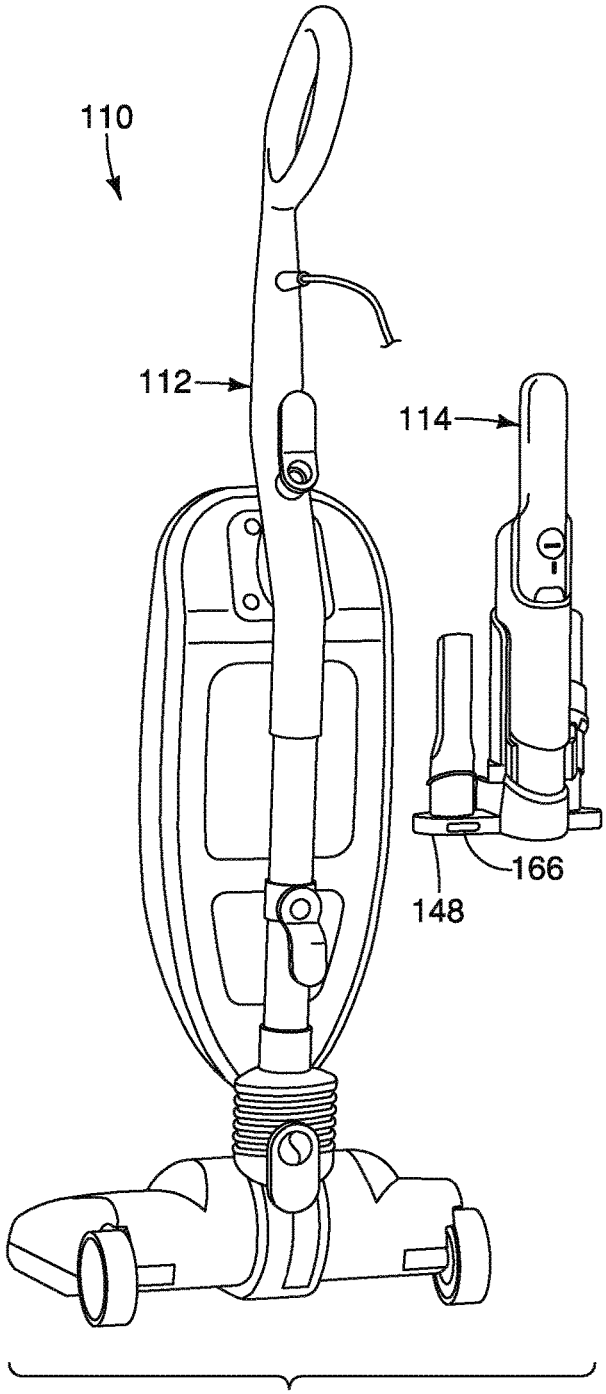
FIG. 7 is an exploded assembly view of the vacuum cleaner assembly of FIG. 6.
Figure 8:
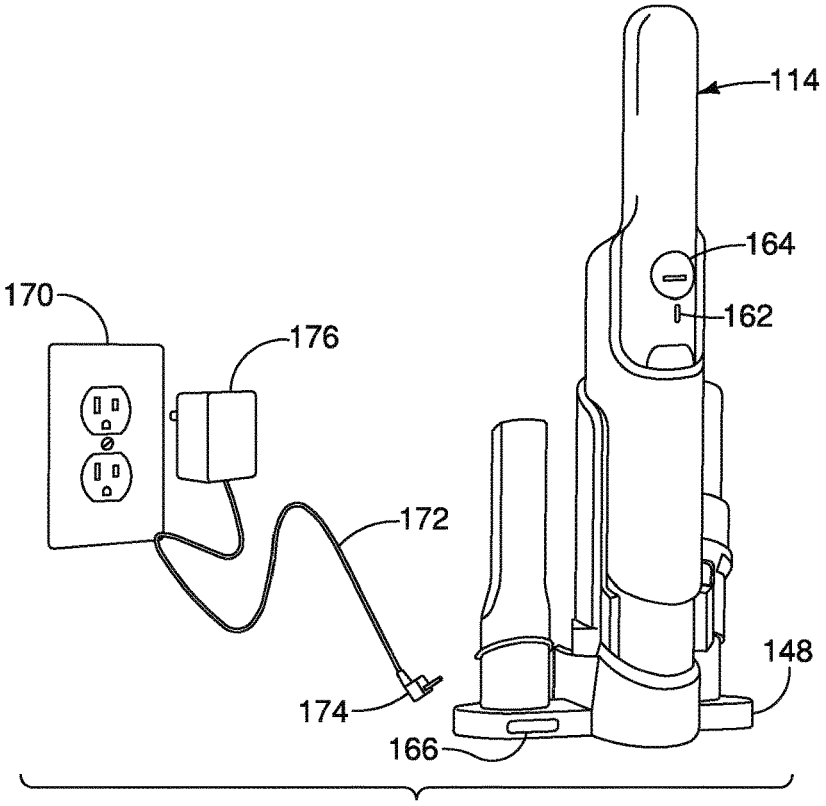
FIG. 8 is a perspective view of a handheld vacuum cleaner assembly detached from the vacuum cleaner of FIG. 6 prior to connecting to a power source for charging.
Figure 11:
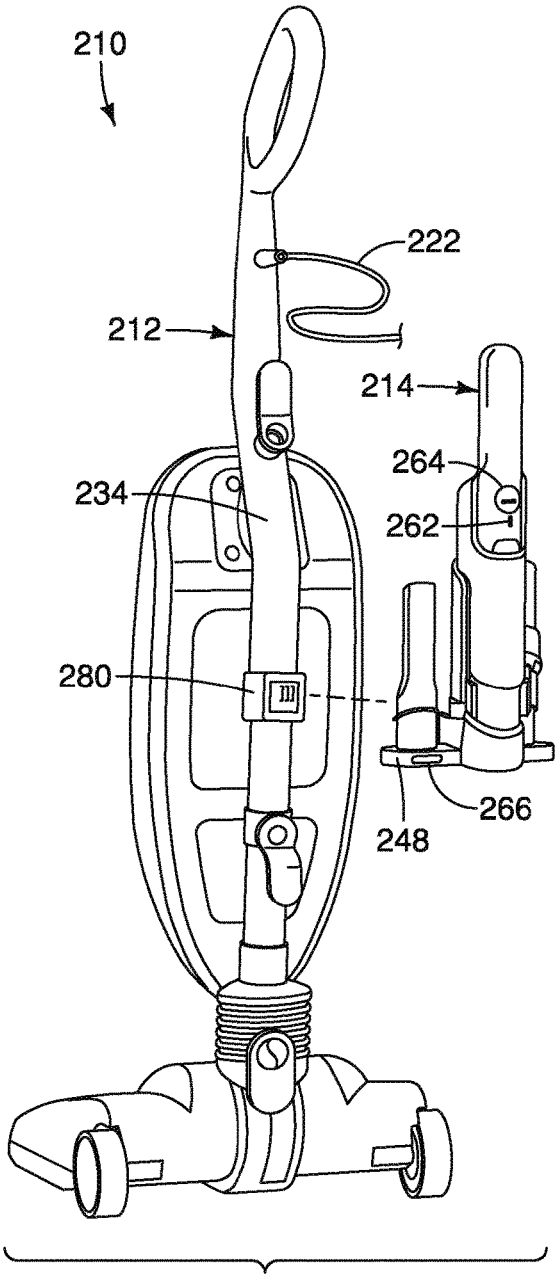
FIG. 11 is an exploded assembly view of the vacuum cleaner assembly of FIG. 10.
Figure 12:
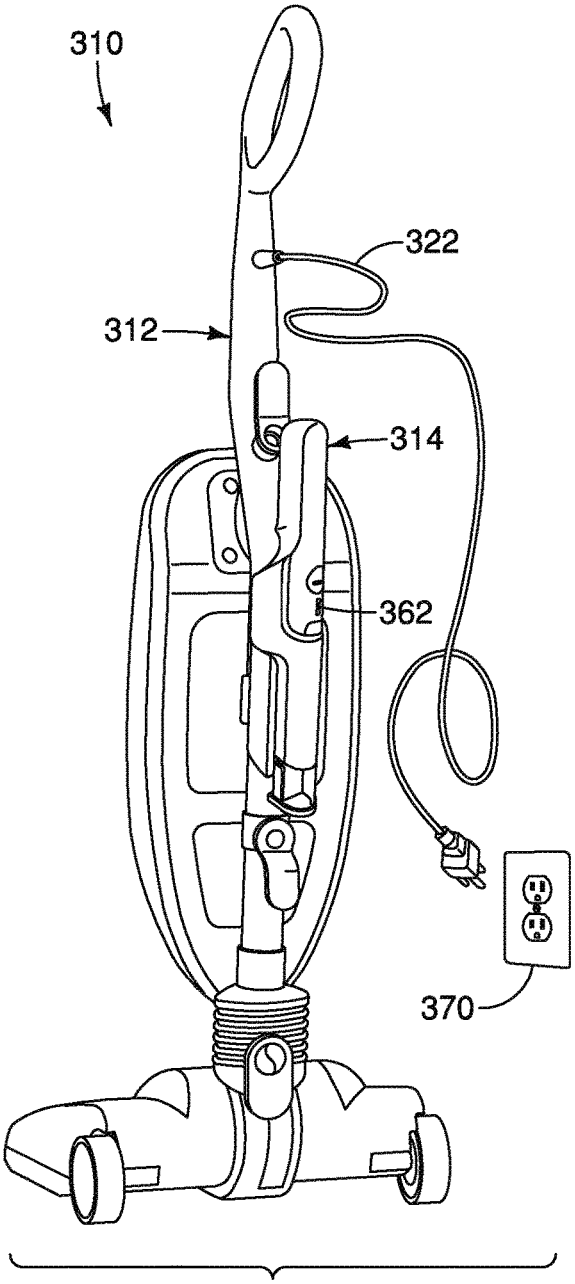
FIG. 12 is a perspective view of a vacuum cleaner assembly of another exemplary embodiment of the present invention in which the handheld vacuum cleaner is directly connected to a vacuum cleaner.
Figure 13:
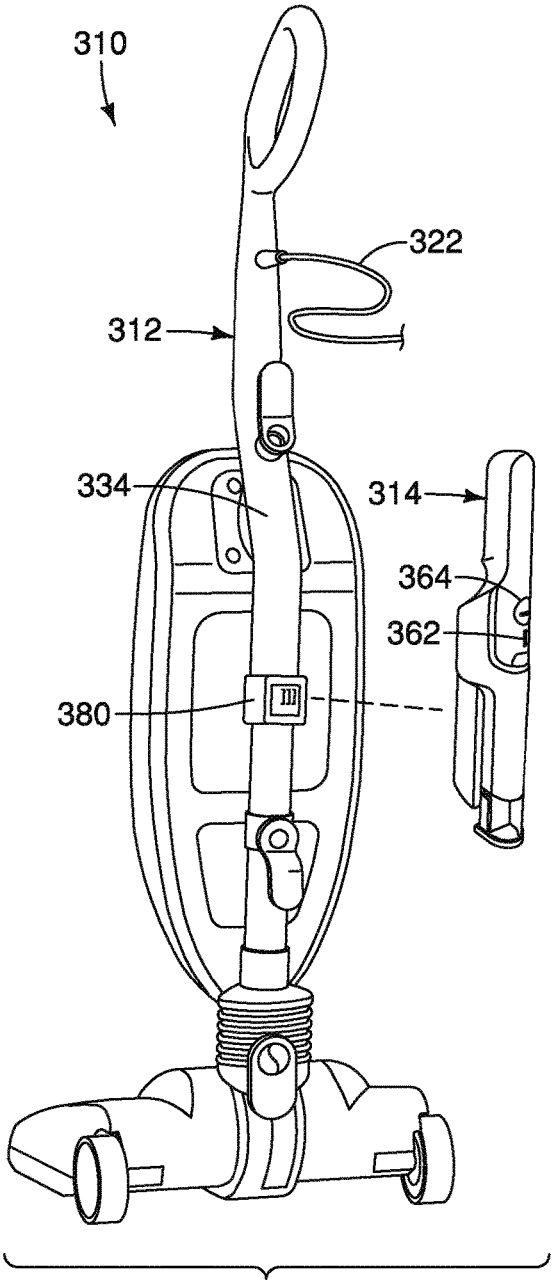
FIG. 13 is a perspective view of the vacuum cleaner assembly of FIG. 12 in which the handheld vacuum cleaner is detached from the vacuum cleaner.

The rechargeable batteries 59 of the handheld vacuum cleaner 14 can be charged through the support member 48. As shown in FIGS. 6-9, the handheld vacuum cleaner 14 is charged through the support member 48 when the support member is removed from the vacuum cleaner 12 and connected to an external power source, such as an electrical outlet 170 (FIG. 8). As shown in FIGS. 10 and 11, the handheld vacuum cleaner 14 is charged through the support member 48 when the support member is connected to the vacuum cleaner 12. As shown in FIGS. 12 and 13, the handheld vacuum cleaner 14 is directly connected to and charged directly through the vacuum cleaner 12. The handheld vacuum cleaner 14 has a charge level indicator 62 that indicates a charge level of the rechargeable batteries 59.

The vacuum cleaner assembly 10 is operable such that the vacuum cleaner 12 and the handheld vacuum cleaner 14 are operable at the same time when the handheld vacuum cleaner 14 is not connected to the vacuum cleaner 12, as shown in FIG. 3. The vacuum cleaner 12 is operable as shown in FIGS. 1 and 2 with the handheld vacuum cleaner 14 received by the support member 48. The suction inlet 58 (FIG. 3) of the handheld vacuum cleaner 14 is covered by the support member 48, as shown in FIGS. 1 and 2, when the handheld vacuum cleaner 14 is received by the support member 48. The vacuum cleaner 12 is powered by a first power source, such as electrical outlet 270 (FIG. 10). The first suction path 30 of the vacuum cleaner 12 is separate from the second suction path 56 of the handheld vacuum cleaner 14.

The handheld vacuum cleaner 14 can be disconnected from the vacuum cleaner 12 for use. The second power source of the handheld vacuum cleaner 14 is separate from the first power source of the vacuum cleaner 12 and the first suction path 30 of the vacuum cleaner 12 is separate from the second suction path 56 of the handheld vacuum cleaner 14 such that the vacuum cleaner 12 and the handheld vacuum cleaner 14 can be separately operated at the same time when the handheld vacuum cleaner 14 is not connected to the vacuum cleaner 12. A power button 64 disposed on the housing 50 of the handheld vacuum cleaner 14 starts and stops the supply of power from the second power source to the motor 52. The power button 64 can include an indicator, such as an LED, that illuminates to indicate that handheld vacuum cleaner 14 is in an operational state, and is not illuminated when the handheld vacuum cleaner 14 is not operational.

As shown in FIGS. 1 and 2, the dust bin 46 of the vacuum cleaner 12 is accessible when the handheld vacuum cleaner 14 is connected to the vacuum cleaner 12. The housing 18 is disposed on a first side of the intake tube 34. The handheld vacuum cleaner 14 id disposed on a second and opposite side of the intake tube 34 such that the dust bin 46 of the vacuum cleaner 12 is accessible when the handheld vacuum cleaner 14 is connected to the vacuum cleaner. The dust bin 54 of the handheld vacuum cleaner 14 is preferably inaccessible when the handheld vacuum cleaner 14 is connected to the vacuum cleaner 12. In other words, the dust bin 54 of the handheld vacuum cleaner 14 is accessible when the handheld vacuum cleaner 14 is removed from the vacuum cleaner 12.

As shown in FIGS. 6-9, a vacuum cleaner assembly 110 in accordance with a second exemplary embodiment of the present invention is substantially similar to the vacuum cleaner assembly 10 of the first exemplary embodiment except for the differences described below. Similar parts are identified with similar reference numerals, except increased by 100 (i.e., 1xx, accordingly).

Figure 9:
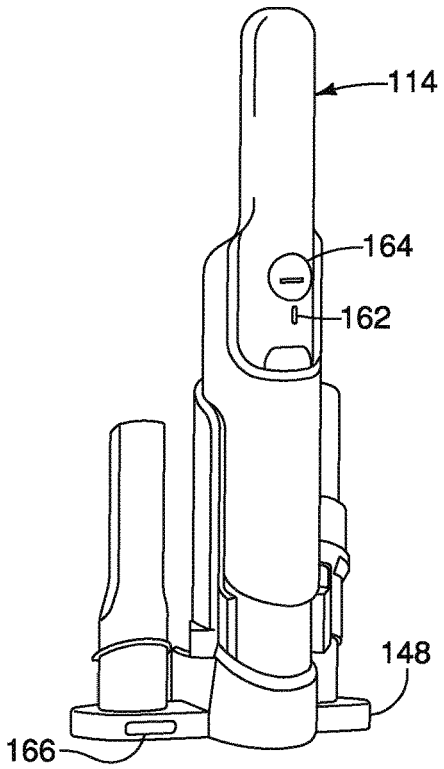
FIG. 9 is a perspective view of the handheld vacuum cleaner assembly of FIG. 7.

The support member 148 includes a charging circuit to charge the rechargeable battery 59 (FIG. 5) disposed in the housing of the handheld vacuum cleaner 114. As shown in FIGS. 7-9, the handheld vacuum cleaner 114 is removed from the vacuum cleaner 112 for charging. A power cord 172 extends between the support member 148 and an electrical outlet 170, as shown in FIG. 8. A first end 174 of the power cord 172 is connected to the support member 148. A second end 176 of the power cord 172 is connected to the electrical outlet 170. Connecting the power cord 172 between the support member 148 and the electrical outlet 170 supplies power to recharge the battery of the handheld vacuum cleaner 114. A charging status indicator 162 can be disposed on the handheld vacuum cleaner 114. Alternatively, a charging status indicator 166 can be disposed on the support member 148. The power cord 172 can be stored in the support member 148 when not in use. Alternatively, the power cord can be stored on the vacuum cleaner 112 when not in use.

Operation of the handheld vacuum cleaner 114 is similar to operation of the handheld vacuum cleaner 14 of FIGS. 1-5. The handheld vacuum cleaner 114 is removed from the support member for operation. A power button 164 disposed on the handheld vacuum cleaner 114 switches between on and off operational states.

As shown in FIGS. 10-11, a vacuum cleaner assembly 210 in accordance with a third exemplary embodiment of the present invention is substantially similar to the vacuum cleaner assembly 10 of the first exemplary embodiment except for the differences described below. Similar parts are identified with similar reference numerals, except increased by 200 (i.e., 2xx, accordingly).

The support member 248 includes a charging circuit to charge the rechargeable battery 59 (FIG. 5) disposed in the housing of the handheld vacuum cleaner 214. As shown in FIGS. 10-11, the handheld vacuum cleaner 214 is electrically connected to the vacuum cleaner 212 for charging. A charging port 280 is connected to the vacuum cleaner 212, such as to the intake tube 234. Electrical wiring is disposed in the intake tube 234 to electrically connect the charging port 280 and the power cord 222 of the vacuum cleaner 212. The support member 248 includes a charging connector (not shown) electrically received by the charging port 280.

When the power cord 222 of the vacuum cleaner 212 is connected to an electrical outlet 270, power is supplied through the power cord 222, and through the electrical wiring disposed in the intake tube 224 to the charging port 280. The handheld vacuum cleaner 214 is charged when connected to the support member 248 that is connected to the vacuum cleaner 212 during operation of the vacuum cleaner 212.

A charging status indicator 262 can be disposed on the handheld vacuum cleaner 214 to indicate a charge level of the battery. Alternatively, a charging status indicator 266 can be disposed on the support member 248.

Operation of the handheld vacuum cleaner 214 is similar to operation of the handheld vacuum cleaner 14 of FIGS. 1-5. The handheld vacuum cleaner 214 is removed from the support member 248 for operation. A power button 264 disposed on the handheld vacuum cleaner 214 switches between on and off operational states.

As shown in FIGS. 12-13, a vacuum cleaner assembly 310 in accordance with a fourth exemplary embodiment of the present invention is substantially similar to the vacuum cleaner assembly 10 of the first exemplary embodiment except for the differences described below. Similar parts are identified with similar reference numerals, except increased by 300 (i.e., 3xx, accordingly).

The handheld vacuum cleaner 314 includes a charging circuit to charge the rechargeable battery 59 (FIG. 5) disposed in the housing thereof. As shown in FIGS. 12-13, the handheld vacuum cleaner 314 is electrically connected to the vacuum cleaner 312 for charging. A charging port 380 is connected to the vacuum cleaner 312, such as to the intake tube 334. Electrical wiring is disposed in the intake tube 334 to electrically connect the charging port 380 and the power cord 322 of the vacuum cleaner 312. The handheld vacuum cleaner 314 includes a charging connector (not shown) electrically received by the charging port 380.

When the power cord 322 of the vacuum cleaner 312 is connected to an electrical outlet 370, power is supplied through the power cord 322, and through the electrical wiring disposed in the intake tube 324 to the charging port 380. The handheld vacuum cleaner 314 is charged when connected to the vacuum cleaner 312 during operation of the vacuum cleaner 312.

A charging status indicator 362 can be disposed on the handheld vacuum cleaner 314 to indicate a charge level of the battery.

Operation of the handheld vacuum cleaner 314 is similar to operation of the handheld vacuum cleaner 14 of FIGS. 1-5. The handheld vacuum cleaner 314 is removed from the vacuum cleaner 312 for operation. A power button 364 disposed on the handheld vacuum cleaner 314 switches between on and off operational states.

Figure 14:
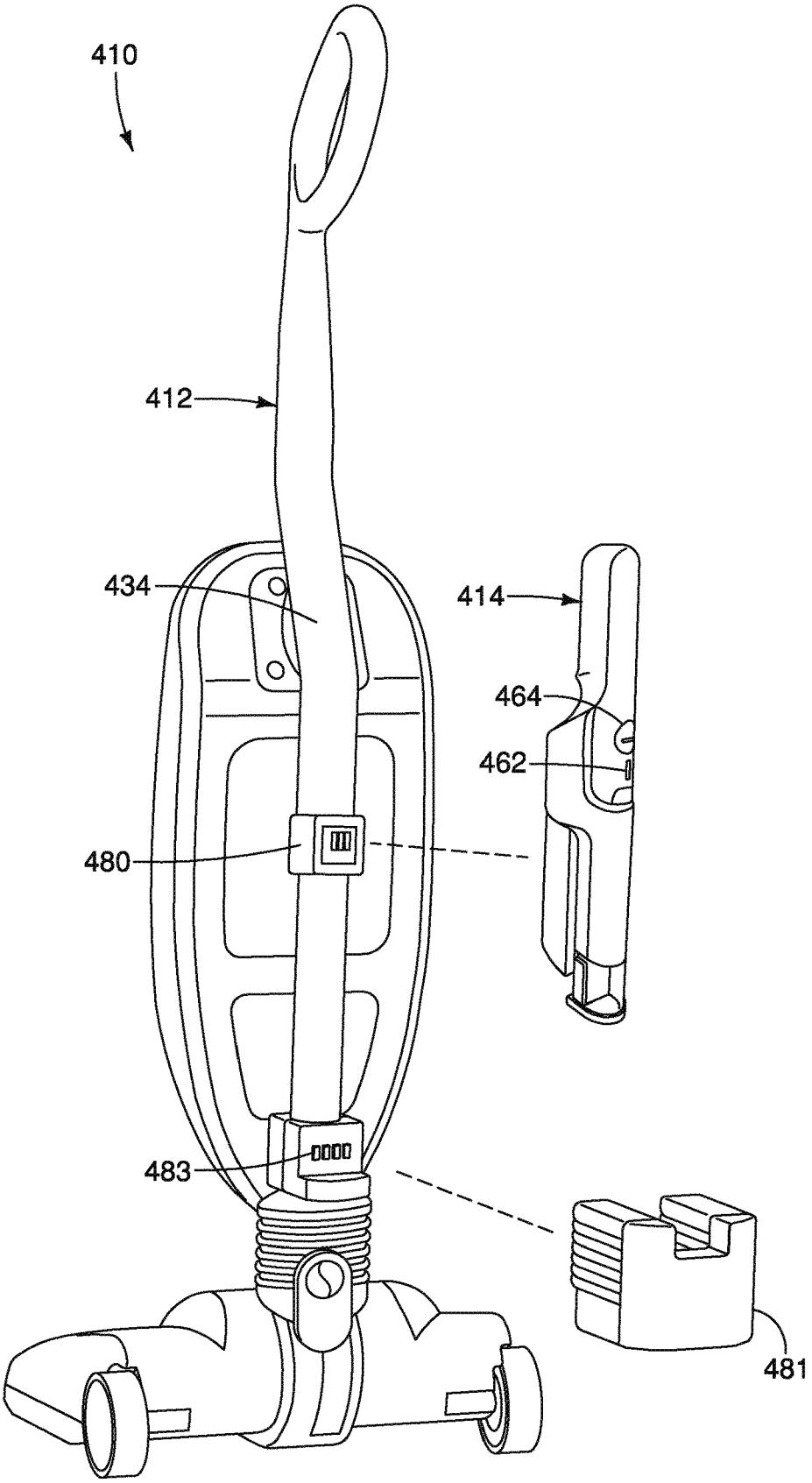
FIG. 14 is a perspective view of a vacuum cleaner assembly of another exemplary embodiment of the present invention in which a handheld vacuum cleaner and a handheld vacuum cleaner are battery powered.

As shown in FIG. 14, a vacuum cleaner assembly 410 in accordance with a fifth exemplary embodiment of the present invention is substantially similar to the vacuum cleaner assembly 10 of the first exemplary embodiment except for the differences described below. Similar parts are identified with similar reference numerals, except increased by 400 (i.e., 4xx, accordingly).

The vacuum cleaner 412 and the handheld vacuum cleaner 414 of the vacuum cleaner assembly 410 are both battery powered. The power source of the vacuum cleaner 412 is a battery pack assembly 481. The battery pack assembly 481 is electrically connected to electrical contacts 483 disposed on the vacuum cleaner 412, such as on the intake tube 434. Corresponding electrical contacts (not shown) are disposed on the battery pack assembly 481. The battery pack assembly 481 includes at least one battery that is preferably rechargeable. The battery pack assembly 481 includes a charging port such that a power cord can be connected between a charging source, such as an electrical outlet, and the battery pack assembly 481 to charge the at least one battery.

The handheld vacuum cleaner 414 includes a charging circuit to charge the rechargeable battery 59 (FIG. 5) disposed in the housing thereof. As shown in FIG. 14, the handheld vacuum cleaner 414 is electrically connected to the vacuum cleaner 412 for charging. A charging port 480 is connected to the vacuum cleaner 412, such as to the intake tube 434. Electrical wiring is disposed in the intake tube 434 to electrically connect the charging port 480 and the electrical contacts 483 of the vacuum cleaner 412. The handheld vacuum cleaner 414 includes a charging connector (not shown) electrically received by the charging port 480.

When the power cord from the charging source is connected to the battery pack assembly 481, power is supplied through the power cord to charge the at least one battery of the battery pack assembly 481. Power is further supplied through the electrical wiring disposed in the intake tube 424 to the charging port 480 to also charge the at least one battery of the handheld vacuum cleaner 412. The handheld vacuum cleaner 414 is charged when connected to the vacuum cleaner 412 simultaneously with charging of the vacuum cleaner 412.

A charging status indicator 462 can be disposed on the handheld vacuum cleaner 414 to indicate a charge level of the battery. A similar status indicator (not shown) can be disposed on the battery pack assembly 481, or any other suitable location of the vacuum cleaner 412, to indicate a charge level of the at least one battery of the battery pack assembly 481.

Operation of the vacuum cleaner 412 and the handheld vacuum cleaner 414 is similar to operation of the vacuum cleaner 12 and the handheld vacuum cleaner 14 of FIGS. 1-5. The handheld vacuum cleaner 414 is removed from the vacuum cleaner 412 for operation. A power button 464 disposed on the handheld vacuum cleaner 414 switches between on and off operational states.

As shown in FIGS. 15-19, a handheld vacuum cleaner 514 in accordance with a sixth exemplary embodiment of the present invention is substantially similar to the handheld vacuum cleaner 14 of the first exemplary embodiment except for the differences described below. Similar parts are identified with similar reference numerals, except increased by 500 (i.e., 5xx, accordingly).

Figure 15:
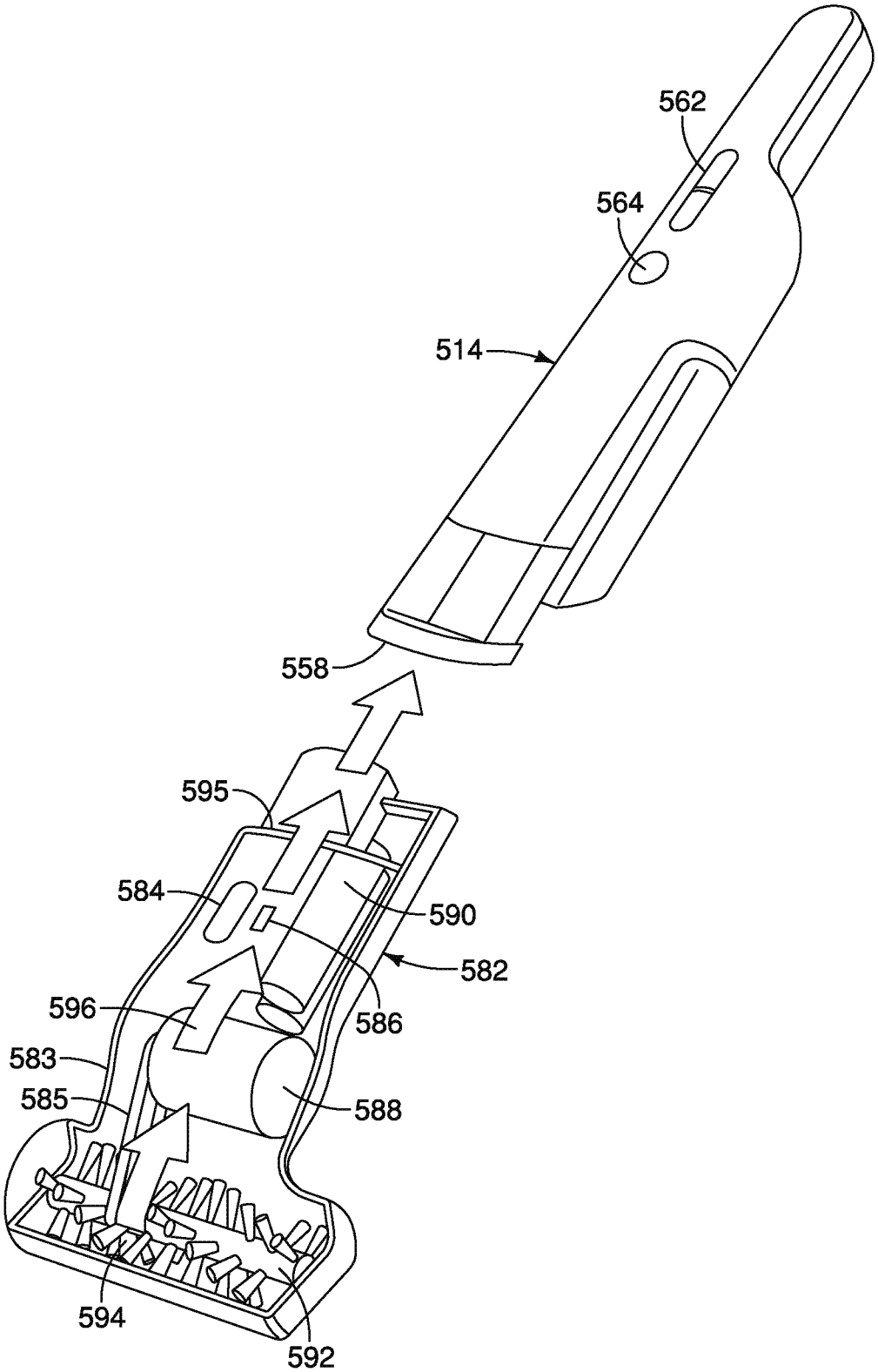
FIG. 15 is a perspective view of a handheld vacuum cleaner assembly in accordance with another exemplary embodiment of the present invention in which a power tool is connectable to a handheld vacuum cleaner.
Figure 16:
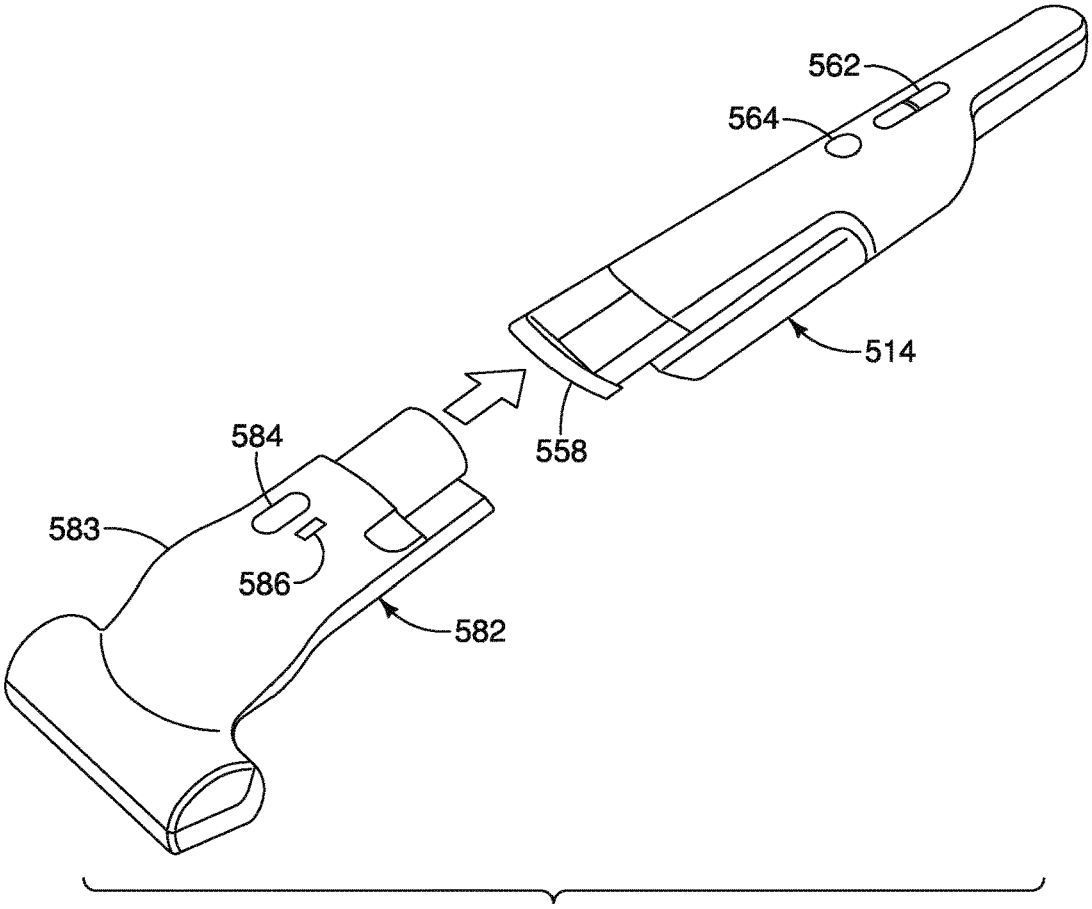
FIG. 16 is an exploded perspective view of the handheld vacuum cleaner and power tool of FIG. 15.
Figure 17:
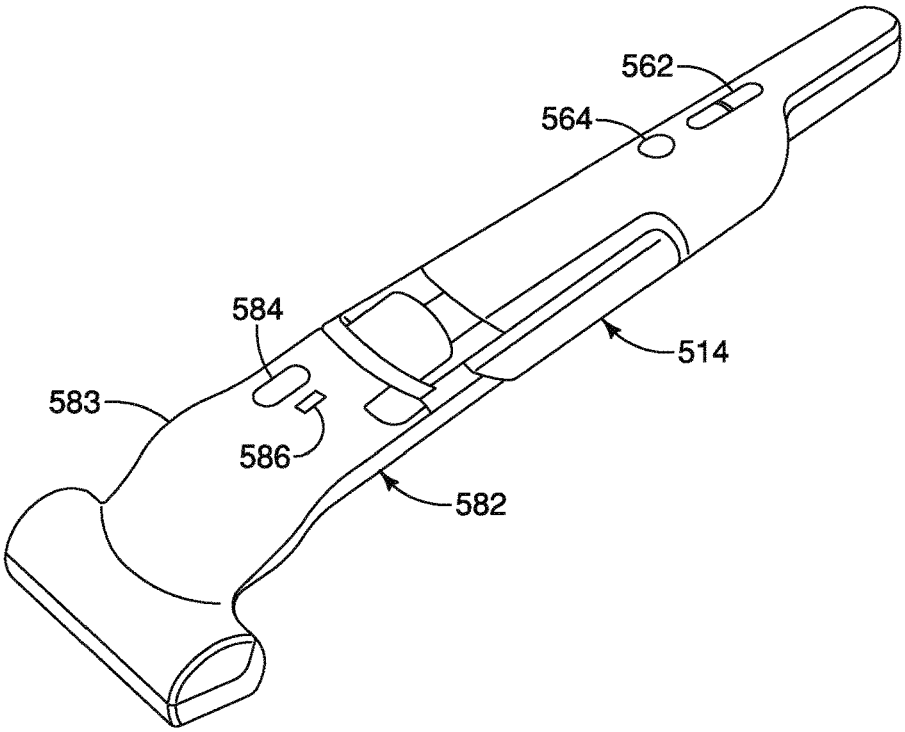
FIG. 17 is a perspective view of the power tool connected to the handheld vacuum cleaner of FIG. 15.

An accessory, such as a rechargeable powerhead 582, is removably connectable to the handheld vacuum cleaner 514, as shown in FIGS. 15-17. The powerhead 582 includes a housing 583 in which a power source, such as a rechargeable battery 590, is disposed. The rechargeable battery 590 supplies power to a motor 588 that drives a surface agitator, such as a brush roll 592. A drive belt 585 extends between a shaft of the motor 588 and the brush roll 592 to drive the brush roll 592. A power button 584 disposed on the housing 583 switches between on and off operational states.

A suction inlet 594 in the housing 583 of the powerhead 582 is associated with the brush roll 592, as shown in FIG. 15. A suction path 596 flows from the suction inlet 594 through the housing 583 to an outlet 595.

The powerhead 582 is connected to the handheld vacuum cleaner 514, as shown in FIGS. 16 and 17. The outlet 595 of the powerhead suction path 596 is connected to the suction inlet 558 of the handheld vacuum cleaner such that the suctions paths of the powerhead 582 and the handheld vacuum cleaner 514 are in fluid communication. The suction path of the handheld vacuum cleaner 514 is illustrated in FIG. 5.

The power source of the powerhead 582 is separate from the power source of the handheld vacuum cleaner 514. A power button 564 of the handheld vacuum cleaner 514 powers the suction motor 52 (FIG. 5) to generate suction. A power button 584 of the powerhead 582 powers the motor 588 to drive the brush roll 592. The handheld vacuum cleaner 514 can be used alone, or with the powerhead 582 when a brush roll 592 is desired.

Figure 18:
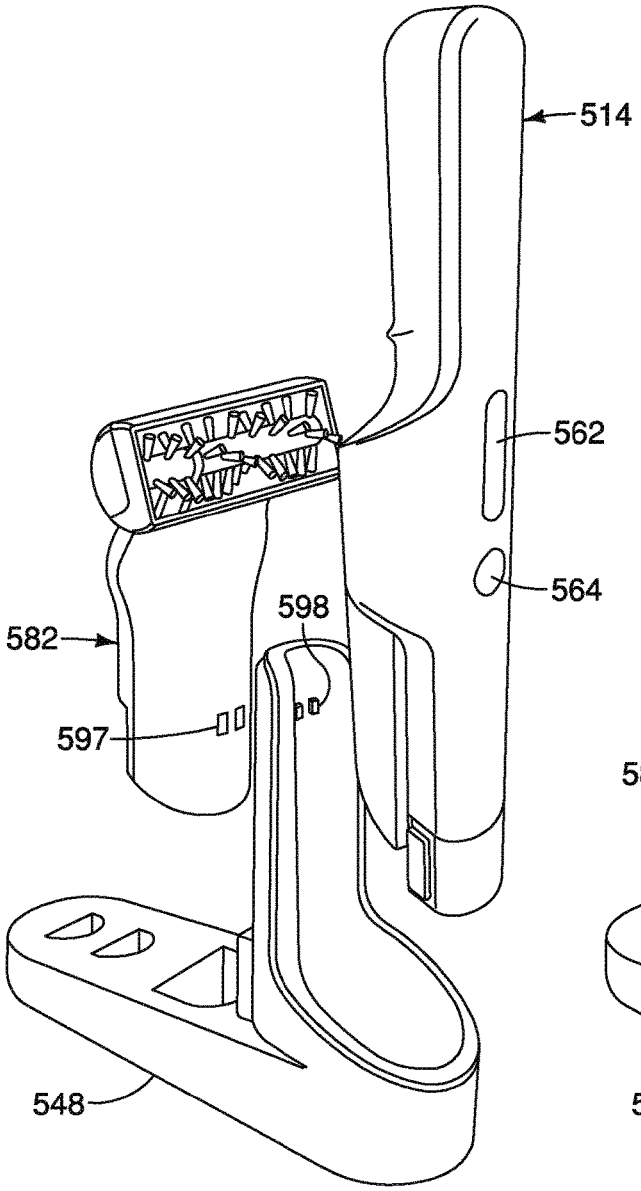
FIG. 18 is a perspective view of the handheld vacuum cleaner and the power tool prior to being received by a charging base.
Figure 19:
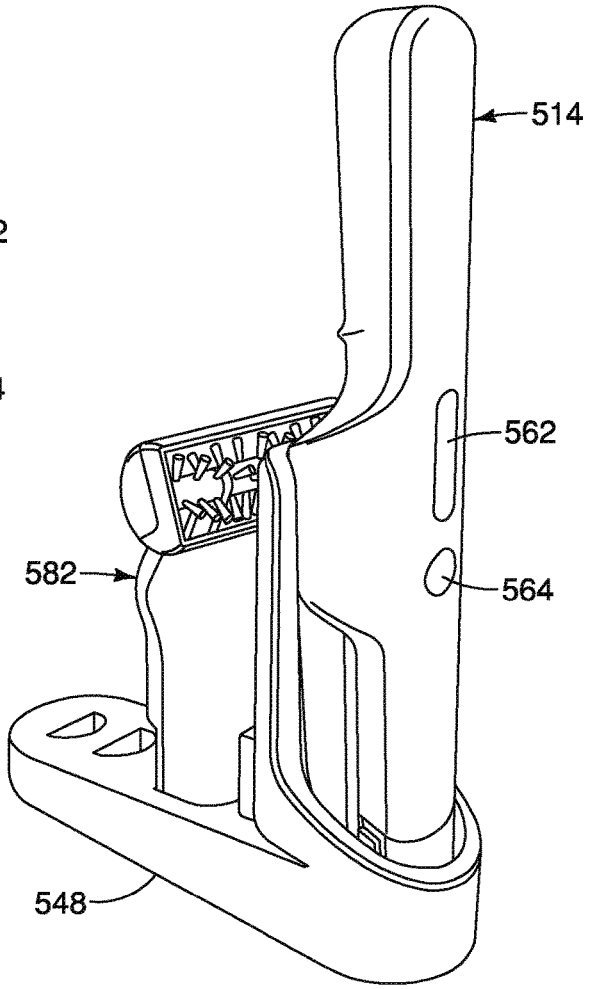
FIG. 19 is a perspective view of the handheld vacuum cleaner and the power tool received by the charging base of FIG. 18.

As shown in FIGS. 18 and 19, a support member 548 removably receives the handheld vacuum cleaner 514 and the powerhead 582. The support member 548 includes a plurality of electrical contacts 598 that electrically engage corresponding electrical contacts 597 of the powerhead 582 and electrical contacts (not shown) of the handheld vacuum cleaner 514 to charge the powerhead 582 and the handheld vacuum cleaner 514. Disposing the handheld vacuum cleaner 514 and the powerhead 582 in the support member 548, engages the electrical contacts 598 of the support member 548 with the electrical contacts of the handheld vacuum cleaner 514 and the powerhead 582. The support member 548 can electrically charge the handheld vacuum cleaner 514 and the powerhead 582 when the support member is connected to the vacuum cleaner as shown in FIG. 10. Alternatively, the support member 548 can charge the handheld vacuum cleaner 514 and the powerhead 582 when the support member 548 is connected to an electrical outlet as shown in FIG. 8. The handheld vacuum cleaner 514 and the powerhead 582 each have charging indicators, such as the charging indicator 562 of the handheld vacuum cleaner 514 and the charging indicator 586 of the powerhead 582, to indicate a charge status of the rechargeable battery.

The foregoing detailed description of the in exemplary embodiments has been provided for the purpose of explaining the principles of the invention and its practical application, thereby enabling others skilled in the art to understand the invention for various exemplary embodiments and with various modifications as are suited to the particular use contemplated. This description is not necessarily intended to be exhaustive or to limit the invention to the exemplary embodiments disclosed. Any of the exemplary embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts unless otherwise stated.

As used herein, the following directional terms "forward", "rearward", "front", "rear", "up", "down", "above", "upper", "below", "lower", "upward", "upwardly", "downward", "downwardly", "top", "bottom", "side", "vertical", "horizontal", "perpendicular" and "transverse" as well as any other similar directional terms refer to those directions of a vacuum cleaner in an upright position for use. Accordingly, these directional terms, as utilized to describe the vacuum cleaner should be interpreted relative to a vacuum cleaner in an upright position on a horizontal surface. The terms "left" and "right" are used to indicate the "right" when referencing from the right side as viewed from the rear of the vacuum cleaner, and the "left" when referencing from the left side as viewed from the rear of the vacuum cleaner.

Also, it will be understood that although the terms "first" and "second" may be used herein to describe various components, these components should not be limited by these terms. These terms are only used to distinguish one component from another. Thus, for example, a first component discussed above could be termed a second component and vice versa without departing from the teachings of the present invention. The term "attached" or "attaching", as used herein, encompasses configurations in which an element is directly secured to another element by affixing the element directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined", "connected", "coupled", "mounted", "bonded", "fixed" and their derivatives. Finally, terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, unless specifically stated otherwise, the size, shape, location or orientation of the various components can be changed as needed and/or desired so long as the changes do not substantially affect their intended function. Unless specifically stated otherwise, components that are shown directly connected or contacting each other can have intermediate structures disposed between them so long as the changes do not substantially affect their intended function. The functions of one element can be performed by two, and vice versa unless specifically stated otherwise. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the exemplary embodiments according to the present invention are provided for illustration only, and not for the purpose of limiting the invention as defined by the appended claims and their equivalents.

What is claimed is:

1. A vacuum cleaner assembly, comprising:

a vacuum cleaner including a first motor configured to create flow through a first suction path, the first motor being configured to be powered by a first power source;

a first housing; and a first dust bin disposed in the first housing and in fluid communication with the first suction path; and a handheld vacuum cleaner removably connected to the vacuum cleaner, the handheld vacuum cleaner including a second housing;

a second motor configured to create flow through a second suction path, the second motor being configured to be powered by a second power source, the second power source being a rechargeable battery disposed in the second housing;

and a second dust bin connected to the second housing and in fluid communication with the second suction path;

the vacuum cleaner further including a support member removably connected to the vacuum cleaner, the support member removably receiving the handheld vacuum cleaner, the support member including a charging circuit to charge the rechargeable battery, the support member including a power cord configured to be connected to an electrical socket to charge the rechargeable battery when the support member is removed from the vacuum cleaner.

2. The vacuum cleaner assembly according to claim 1, wherein the first power source is an electrical outlet.

3. The vacuum cleaner assembly according to claim 1, wherein the first suction path is separate from the second suction path.

4. The vacuum cleaner assembly according to claim 1, wherein the rechargeable battery is charged when the support member is connected to the vacuum cleaner.

5. The vacuum cleaner assembly according to claim 1, wherein the support member is configured to receive an accessory configured to be connected to the handheld vacuum cleaner.

6. The vacuum cleaner assembly according to claim 1, wherein the handheld vacuum cleaner includes a suction inlet in fluid communication with the second suction path, the suction inlet being covered by the support member when the handheld vacuum cleaner is received by the support member.

7. The vacuum cleaner assembly according to claim 1, wherein the support member includes a charge level indicator to indicate a charge level of the rechargeable battery.

8. The vacuum cleaner assembly according to claim 1, wherein the first power source is a rechargeable battery.

9. The vacuum cleaner assembly according to claim 8, wherein the rechargeable battery of the vacuum cleaner and the rechargeable battery of the handheld vacuum cleaner are chargeable at the same time when the handheld vacuum cleaner is connected to the vacuum cleaner.

10. The vacuum cleaner assembly according to claim 1, wherein the vacuum cleaner and the handheld vacuum cleaner are operable at the same time when the handheld vacuum cleaner is not connected to the vacuum cleaner.

11. The vacuum cleaner assembly according to claim 1, wherein the first dust bin is accessible when the handheld vacuum cleaner is connected to the vacuum cleaner, and the second dust bin is inaccessible when the handheld vacuum cleaner is connected to the vacuum cleaner.

12. A vacuum cleaner assembly, comprising:

a vacuum cleaner including a first motor configured to create flow through a first suction path, the first motor being configured to be powered by a first power source;

a first housing; and a first dust bin disposed in the first housing and in fluid communication with the first suction path; and a handheld vacuum cleaner removably connected to the vacuum cleaner, the handheld vacuum cleaner including a second housing;

a second motor configured to create flow through a second suction path, the second motor being configured to be powered by a second power source, the second power source being a rechargeable battery disposed in the second housing; and a second dust bin connected to the second housing and in fluid communication with the second suction path;

the vacuum cleaner further including a support member removably connected to the vacuum cleaner, the support member removably receiving the handheld vacuum cleaner; and an accessory configured to be removably connected to the handheld vacuum and removably received by the support member, the accessory being powered by a third power source.

13. The vacuum cleaner assembly according to claim 12, wherein the first power source is an electrical outlet.

14. The vacuum cleaner assembly according to claim 12, wherein the first power source is a rechargeable battery.

15. The vacuum cleaner assembly according to claim 14, wherein the rechargeable battery of the vacuum cleaner and the rechargeable battery of the handheld vacuum cleaner are chargeable at the same time when the handheld vacuum cleaner is connected to the vacuum cleaner.

16. A vacuum cleaner assembly, comprising:

a vacuum cleaner including a first motor configured to create flow through a first suction path, the first motor being configured to be powered by a first power source;

a first housing; and a first dust bin disposed in the first housing and in fluid communication with the first suction path; and a handheld vacuum cleaner removably connected to the housing, the handheld vacuum cleaner including a second motor configured to create flow through a second suction path, the second motor being configured to be powered by a second power source, the second power source being a rechargeable battery disposed in the second housing;

a second housing; and a second dust bin connected to the second housing and in fluid communication with the second suction path; and a support member removably connected to the vacuum cleaner, the support member removably receiving the handheld vacuum cleaner, the support member including a charging circuit configured to charge the rechargeable battery; and an accessory configured to be removably connected to the handheld vacuum and removably received by the support member, the accessory being powered by a third power source, the first suction path being separate from the second suction path, and the vacuum cleaner and the handheld vacuum cleaner are operable at the same time when the handheld vacuum cleaner is not connected to the vacuum cleaner.

17. The vacuum cleaner assembly according to claim 16, wherein the charging circuit charges the rechargeable battery when the support member is connected to the vacuum cleaner.

18. The vacuum cleaner assembly according to claim 16, wherein the first power source is an electrical outlet.

19. The vacuum cleaner assembly according to claim 16, wherein the first power source is a rechargeable battery.

20. The vacuum cleaner assembly according to claim 19, wherein the rechargeable battery of the vacuum cleaner and the rechargeable battery of the handheld vacuum cleaner are chargeable at the same time when the handheld vacuum cleaner is connected to the vacuum cleaner.

* * * * *